US008714116B2

(12) United States Patent
Hartman et al.

(10) Patent No.: US 8,714,116 B2
(45) Date of Patent: May 6, 2014

(54) ENGINE COOLING FAN SPEED CONTROL SYSTEM

(75) Inventors: Brian A. Hartman, Willowbrook, IL (US); Jeffrey A. Koth, Plainfield, IL (US); Daniel Alan Morey, Mundelein, IL (US); Alessandro Carnevali, Rubiera (IT)

(73) Assignee: CNH Industrial America LLC, New Holland, PA (US)

( * ) Notice: Subject to any disclaimer, the term of this patent is extended or adjusted under 35 U.S.C. 154(b) by 238 days.

(21) Appl. No.: 13/106,462

(22) Filed: May 12, 2011

(65) Prior Publication Data

US 2012/0288377 A1 Nov. 15, 2012

(51) Int. Cl.

| | |
|---|---|
| ***F01P 9/00*** | (2006.01) |
| ***F01P 7/02*** | (2006.01) |
| ***F01P 7/10*** | (2006.01) |

(52) U.S. Cl.

USPC ..... 123/41.49; 123/41.01; 123/41.11; 123/41.12

(58) Field of Classification Search

USPC ..... 123/41.01, 41.11, 41.49, 41.12

See application file for complete search history.

(56) References Cited

U.S. PATENT DOCUMENTS

| | | | | | |
|---|---|---|---|---|---|
| 4,874,072 | A | * | 10/1989 | Mohan et al. | 192/58.61 |
| 5,392,741 | A | * | 2/1995 | Uzkan | 123/41.13 |
| 5,483,927 | A | * | 1/1996 | Letang et al. | 123/41.12 |
| 5,584,371 | A | * | 12/1996 | Kelledes et al. | 192/58.61 |
| 5,947,247 | A | * | 9/1999 | Cummings, III | 192/70.12 |
| 6,003,455 | A | * | 12/1999 | Flamme et al. | 111/200 |
| 6,006,731 | A | | 12/1999 | Uzkan | |
| 6,030,314 | A | * | 2/2000 | Brooks et al. | 477/92 |
| 6,109,219 | A | * | 8/2000 | Sano | 123/41.1 |
| 6,328,000 | B1 | * | 12/2001 | Hawkins et al. | 123/41.12 |
| 6,548,929 | B2 | * | 4/2003 | Nelson et al. | 310/105 |
| 6,600,249 | B2 | * | 7/2003 | Nelson et al. | 310/91 |
| 6,651,761 | B1 | * | 11/2003 | Hrovat et al. | 429/442 |
| 6,772,714 | B2 | * | 8/2004 | Laird et al. | 123/41.12 |
| 7,134,406 | B1 | * | 11/2006 | Loes | 123/41.11 |
| 7,138,781 | B2 | * | 11/2006 | Murray et al. | 318/400.04 |
| 7,310,959 | B2 | * | 12/2007 | Braun et al. | 62/178 |
| 7,331,760 | B2 | * | 2/2008 | Furuta | 416/1 |
| 7,494,256 | B1 | * | 2/2009 | Kelman et al. | 362/489 |

(Continued)

FOREIGN PATENT DOCUMENTS

| | | | | | |
|---|---|---|---|---|---|
| JP | 09092311 | A | * | 9/1997 | H01M 8/04 |

OTHER PUBLICATIONS

JP 09092311A—abstract translation.*
JP 09092311A, Sep. 1997—abstract translation.*

*Primary Examiner* — Noah Kamen
*Assistant Examiner* — Tea Holbrook
(74) *Attorney, Agent, or Firm* — Sue C. Watson

(57) ABSTRACT

A fan cooling system and method are provided to control fan speed for cooling vehicle motor components while minimizing power consumption by the fan and reducing engine fuel consumption for an engine partially powering the fan. The fan cooling system raises engine coolant temperature of a vehicle in motion to derive a fan speed demand so that fan speed may be reduced. The fan cooling system selects a maximum fan speed demand from one or more fan speed demands to command fan speed based on various sensed inputs, including engine coolant temperatures. The fan cooling system also improves cooling efficiency by incorporating slipheat protection for the fan so as not to overdrive the fan for cooling.

27 Claims, 5 Drawing Sheets

(56) References Cited

U.S. PATENT DOCUMENTS

| | | | | |
|---|---|---|---|---|
| 7,863,839 | B2 * | 1/2011 | Schuricht et al. | 318/268 |
| 2002/0096133 | A1 * | 7/2002 | McGovern et al. | 123/41.48 |
| 2003/0041814 | A1 * | 3/2003 | Laird et al. | 123/41.12 |
| 2004/0045749 | A1 * | 3/2004 | Jaura et al. | 180/65.2 |
| 2004/0144107 | A1 * | 7/2004 | Breton et al. | 62/129 |
| 2005/0124461 | A1 * | 6/2005 | Inoue et al. | 477/179 |
| 2007/0129874 | A1 * | 6/2007 | Bays | 701/102 |
| 2007/0163753 | A1 * | 7/2007 | Cochran | 165/104.15 |
| 2008/0236981 | A1 * | 10/2008 | Powers et al. | 192/84.1 |
| 2009/0007856 | A1 * | 1/2009 | Minekawa | 123/41.11 |
| 2009/0062963 | A1 * | 3/2009 | Hayashi | 700/275 |
| 2010/0059325 | A1 | 3/2010 | Boyer | |
| 2010/0107996 | A1 | 5/2010 | Shintani et al. | |
| 2012/0060777 | A1 * | 3/2012 | Tikkanen et al. | 123/41.11 |
| 2012/0061069 | A1 * | 3/2012 | Schwartz | 165/271 |

* cited by examiner

ENGINE COOLING FAN SPEED CONTROL SYSTEM

TECHNOLOGY FIELD

The present invention relates generally to engine cooling fans, and more particularly, an improved engine fan speed control system and method for controlling the engine fan speed of a vehicle fan.

BACKGROUND

Electronic fan control systems and improvements thereof have been integrated into numerous vehicles to cool motor vehicle components by adjusting the rotation of a fan to control airflow about the components to be cooled. Cooling is necessary across the motor vehicle components to prevent overheating due to variances in internal and external temperatures to the motor and due to load variances placed on the vehicle and its motor components.

The fan is located near the vehicle engine to blow air drawn through engine heat exchangers, radiator, etc. over the top of the engine to carry away heat dissipated from the engine and other motor vehicle components. The fan provides cooling air and improves dissipation of heat for components such as engine coolant, transmission oil, and hydraulic oil. The primary power source for the fan is from the vehicle engine. To reach particular fan speeds and thus provide cooling the motor vehicle components can require significant horsepower draw from the engine, thus reducing engine fuel efficiency.

Electronic fan control systems process temperatures sensed at the various motor vehicle components to determine a desired rotational speed for the fan. The control system commands a clutch to drive the rotation of the fan.

In particular, U.S. Pat. No. 6,772,714 Laird et al. and entitled Electronic Fan Control, is a fan control for receiving inputs from sensors and uses the sensor inputs in determining fan speed. Fan speed in this patent can be controlled according to an alternate coolant temperature table when the PTO is activated and the transmission is in park.

With a vehicle in park, load demand variances on the motor vehicle components are non-existent. Load from an engaged PTO is also constant. With loads held constant across the motor vehicle components while the PTO is engaged and the vehicle is in park, increasing the coolant temperature causes little chance of overheating an engine when trying to reduce fan usage to reduce horsepower consumed by the fan.

What is needed is a fan control system to reduce fan speed, thus reducing horsepower consumed by a fan to reduce engine fuel consumption, but still provide cooling needs across the vehicle motor system when the vehicle is stationary or in motion. This would include selecting a minimum fan speed from calculated fan speed demands based on increased higher coolant temperatures not only when the vehicle is in park, but when the vehicle is moving.

SUMMARY

Embodiments of the present invention address and overcome one or more of the above shortcomings and drawbacks, by providing systems, and methods for controlling fan speed in a vehicle. This technology is particularly well-suited for, but by no means limited to, fan control systems in agricultural vehicles.

Embodiments of the present invention are directed to a fan control system for use with a fan cooling system in a vehicle comprising a fan drive for driving a fan blade to rotate at a particular speed. The fan control system further includes one or more sensors for sensing engine conditions and transmission conditions. The fan control system further includes an engine control module coupled to the one or more sensors for receiving engine conditions comprising at least an engine coolant temperature. The engine control module is coupled to a communication link for transmitting engine information comprising engine conditions. The fan control system further includes a transmission control module coupled to the one or more sensors for receiving transmission conditions comprising at least a vehicle speed. The transmission control module is coupled to the communication link for transmitting transmission information comprising transmission conditions. The fan control system further includes a power take off control module coupled to the communication link for transmitting power take off status information. The power take off status information comprises whether a power take off unit on the vehicle is engaged or disengaged. The fan control system further includes a fan control module coupled to the communication link for receiving engine information, transmission information, and power take off status information to process the engine information, the transmission information, and the power take off status information and to generate one or more fan speed demands from the processed information. The fan control module selects from the one or more fan speed demands a maximum fan speed demand to command the fan drive to rotate the fan blade at a commanded rotational fan speed based on the maximum fan speed demand. The fan control module generates at least one of the fan speed demands by processing the engine coolant temperature, the power take off status information, and the vehicle speed. When the vehicle speed of the vehicle is greater than 0 KPH and the power take off unit is engaged, the fan control module raises a set point of the engine coolant temperature to reduce the fan speed demand processed from the engine coolant temperature, the power take off status information, and the vehicle speed. The communication link connects the engine control module, transmission control module, and power take off control module to the fan control module.

According to one embodiment of the invention, the fan control system further includes a fan speed sensor connected to the fan drive to measure the rotational speed of the fan blade and to communicate the sensed rotational speed of the fan blade to the fan control module. According to one aspect of one embodiment of the invention, the fan control module processes the sensed rotational speed of the fan blade with the engine information, transmission information, and power take off status information to generate the one or more fan speed demands. According to another aspect of one embodiment of the invention, the engine information received by the fan control module comprises ambient air temperature and engine rpm and wherein the fan control module processes a slip heat protection based on the ambient air temperature, the engine rpm, the sensed rotational speed of the fan blade, and the selected fan speed demand. According to another aspect of one embodiment of the invention, the fan control module commands the fan drive to change rotation of the fan blade based on the processed slip heat protection so that the fan drive will not maintain a rotational fan speed of the fan blade so as to overheat beyond design limits of the fan drive. According to another aspect of one embodiment of the invention, the fan control module calculates differences between commanded rotational fan speed and sensed rotational fan speed and modulates the commanded rotational fan speed to reduce the differences.

According to another embodiment of the invention, the engine information received by the fan control module includes an intake manifold temperature. The fan control module processes the intake manifold temperature to generate the one or more fan speed demands.

According to another embodiment of the invention, the engine information received by the fan control module includes a catalyst temperature. The fan control module processes the catalyst temperature to generate the one or more fan speed demands.

According to another embodiment of the invention, the fan control module further comprises a timer that counts to a specified time after the vehicle speed drops below a vehicle speed threshold value. According to one aspect of one embodiment of the invention, the fan control module raises the set point of the engine coolant temperature when the specified time is reached if the power take off unit is engaged. According to another aspect of one embodiment of the invention, the vehicle speed threshold value comprises any speed value less than or equal to 5 KPH and greater than 0 KPH.

According to another embodiment of the invention, the set point of the engine coolant temperature comprises a temperature value less than or equal to engine derate temperature. According to one aspect of one embodiment of the invention, the set point of the engine coolant temperature comprises a temperature value approximately 2 degrees Celsius below engine derate temperature. According to another aspect of one embodiment of the invention, the set point of the engine coolant temperature comprises a temperature value approximately 2 degrees Celsius below engine redline as defined on an instrument cluster.

According to another embodiment of the invention, fan control system further includes an air conditioning system module for transmitting air conditioning system status information. The air conditioning system status information includes whether an air conditioning system in the vehicle is turned on or off. According to one aspect of one embodiment of the invention, the fan control module further includes receiving air conditioning status information and an ambient air temperature from the engine information to generate two fan speed demands. The fan control module calculates a first fan speed demand based on a time since air conditioner last turned on in the air conditioning status information and generates a second fan speed demand based on the ambient air temperature.

According to another embodiment of the invention, the communication link is a CAN-bus. According to another embodiment of the invention, the fan drive is a viscous fan drive.

Embodiments of the present invention are directed to a method for controlling the speed of a fan blade in a fan cooling system of a vehicle. The method includes sensing vehicle motor conditions including engine conditions and transmission conditions at one or more sensors. The method further includes receiving at an engine control module one or more engine conditions, including at least an engine coolant temperature, from the one or more sensors. The method further includes transmitting engine information including engine conditions on a communication link from the engine control module to a fan control module. The method further includes receiving at a transmission control module one or more transmission conditions, including at least a vehicle speed, from the one or more sensors. The method further includes transmitting transmission information including transmission conditions on the communication link from the transmission control module to the fan control module. The method further includes transmitting power take off status information from a power take off control module on the communication link from the power take off control module to the fan control module. The power take off status information is whether a power take off unit on the vehicle is engaged or disengaged. The method further includes receiving engine information, transmission information, and power take off status information at the fan control module. The method further includes processing the engine information, transmission information, and power take off status information at the fan control module. The method further includes generating one or more fan speed demands at the fan control module based on the processed engine information, transmission information, and power take off status information. At least one of the fan speed demands is generated by processing the engine coolant temperature, power take off status information, and vehicle speed. The method further includes raising a set point of the engine coolant temperature by the fan control module to reduce the fan speed demand processed from the engine coolant temperature, the power take off status information, and the vehicle speed when the vehicle speed of the vehicle is greater than 0 KPH and the power take off unit is engaged. The method further includes selecting at the fan control module a maximum fan speed demand from the one or more fan speed demands. The method further includes commanding from the fan control module a fan drive to rotate a fan blade connected with the fan drive at a commanded fan speed based on the maximum fan speed demand selected by the fan control module.

According to one embodiment of the invention, the method further includes sensing a rotational fan speed by a fan speed sensor connected with the fan blade and transmitting the sensed speed of the fan to the fan control module from the fan speed sensor. According to one aspect of one embodiment of the invention, the fan control module modifies commanded fan speed based on received sensed fan speed from the fan speed sensor.

According to another embodiment of the invention, the method further includes sensing a gear selected in the transmission system at the one or more sensors, receiving the gear selected in the transmission system at the transmission control module from the one or more sensors, and transmitting the gear selected in the transmission system on the communication link from the transmission control module to the fan control module. According to one aspect of one embodiment of the invention, generating one or more fan speed demands comprises processing the engine coolant temperature, power take off status information, and the selected gear from the transmission information.

According to another embodiment of the invention, the method further includes reducing heat dissipating from the fan drive beyond fan drive design limits by replacing the fan speed command with a lower or higher speed command to the fan drive from the fan control module.

According to another embodiment of the invention, the raising a set point of the engine coolant temperature step further comprises counting a time down to zero after the vehicle speed drops below a vehicle speed threshold and raising the set point when the time reaches zero. According to one aspect of one embodiment of the invention, the vehicle speed threshold value may be any speed value greater than 0 KPH and less than or equal to 5 KPH. According to another aspect of one embodiment of the invention, the method further includes basing the set point of the engine coolant temperature off an engine torque in the engine information when the time has not reached zero or the power take off unit is disengaged.

Additional features and advantages of the invention will be made apparent from the following detailed description of illustrative embodiments that proceeds with reference to the accompanying drawings.

BRIEF DESCRIPTION OF THE DRAWINGS

The foregoing and other aspects of the present invention are best understood from the following detailed description when read in connection with the accompanying drawings. For the purpose of illustrating the invention, there is shown in the drawings embodiments that are presently preferred, it being understood, however, that the invention is not limited to the specific instrumentalities disclosed. Included in the drawings are the following Figures.

DETAILED DESCRIPTION OF ILLUSTRATIVE EMBODIMENTS

The problems in the prior art have motivated the creation of a motor vehicle cooling system incorporating a fan controller and methods to provide cooling needs across the motor of a stationary or moving vehicle, while reducing the horsepower draw of the fan. The fan controller selects a minimum fan speed from calculated fan speed demands based on numerous sensed vehicle motor information. In some embodiments of the invention, fan speed demand is generated from increased higher coolant temperatures whether the vehicle is in motion or in park.

Figure 1:
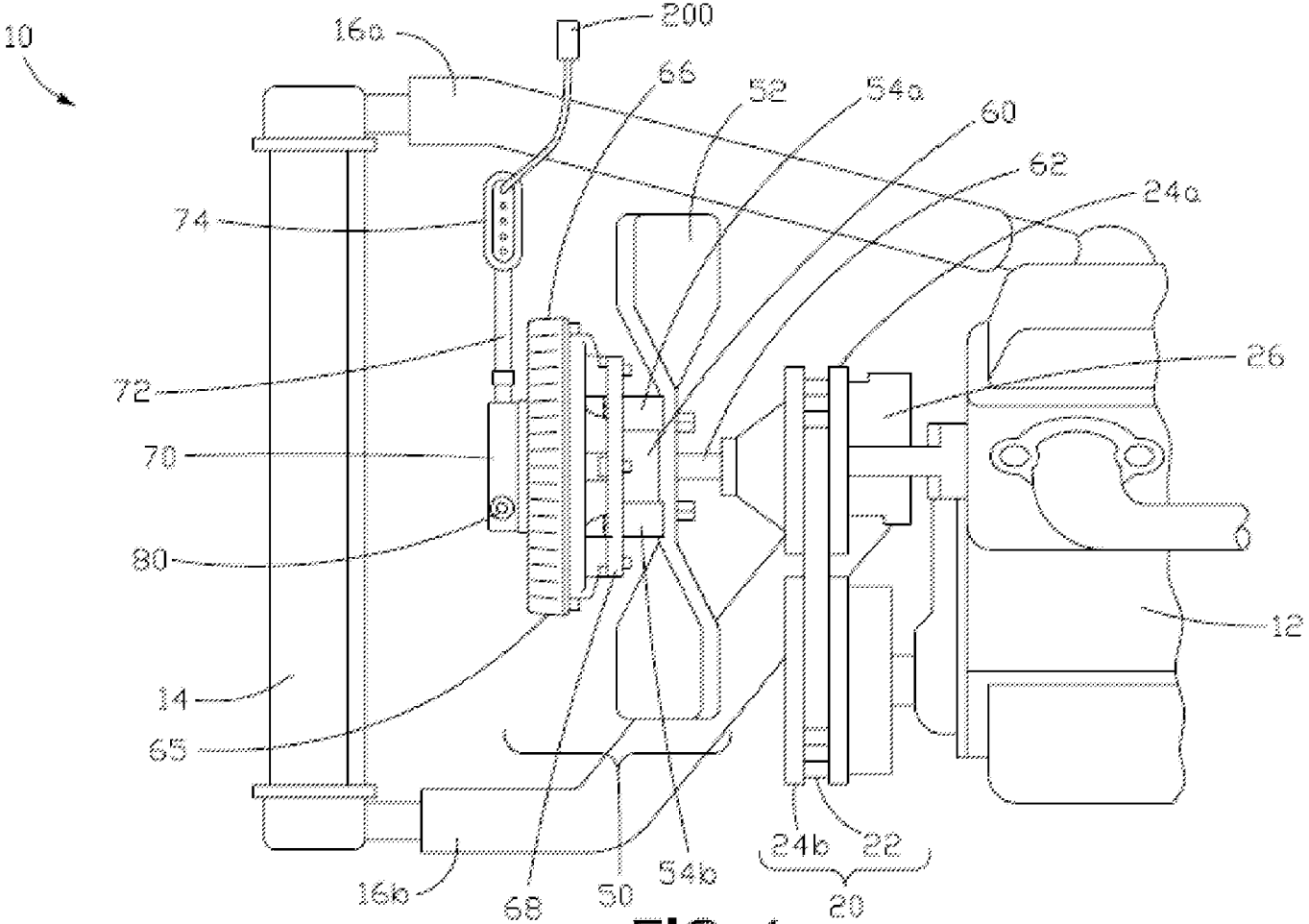
FIG. 1 shows a side view of a viscous fan cooling system for a vehicle in which the embodiments of present invention may be incorporated.

FIG. 1 shows a side view of a fan cooling system for a vehicle in which embodiments of the present invention may be incorporated. The fan cooling system 10, shown in FIG. 1, may be incorporated into various types of vehicles, as for example in a tractor, or a combine, or other agricultural vehicles. The fan cooling system 10 may be placed in proximity to the motor vehicle to draw ambient cooling air from outside the vehicle across vehicle motor components to assist in transfer of heat (e.g., cooling) from the vehicle motor components.

A portion of the engine 12 is shown to the right of connection with a fan pulley assembly 20. The engine 12 may be an internal combustion type engine. The engine 12 is connected to a radiator 14 by a pair of interconnecting hoses, inlet hose 16*a* and outlet hose 16*b*, in which liquid coolant travels from the engine 12 to the radiator 14 via inlet hose 16*a* and back via outlet hose 16*b*.

A viscous fan drive 50 is placed in the fan cooling system 10, between the engine 12 and radiator 14 and the two connection hoses, inlet hose 16*a* and outlet hose 16*b*. The viscous fan drive 50 includes an electrical actuator assembly 70. The electrical actuator assembly 70 is connected to an electrical pin connection 74 via an electrical conduit 72 housing one or more electrical wires (not shown). Pin leads at the pin connection 74 are further connected to power supply modules (not shown) and grounding located elsewhere in the vehicle. Other pin leads are connected to a fan control module 200, further described with reference to FIGS. 2 and 3, wherein electronic signals from the fan control module 200 provide for fan speed commands to the viscous fan drive 50. Other pin leads are connected to the fan control module 200, providing to the fan control module 200 sensed fan speed from a fan speed sensor 80 located within the electrical actuator assembly 70. The fan speed sensor 80 may be a Hall effect type speed sensor. In some embodiments of the invention, fan speed is implemented in an electronic closed-loop feedback to and from the fan control module 200 for controlling speed, as further described with reference to FIG. 3.

The viscous fan drive 50 also includes an input member 60 housing an internal clutch plate (not shown) and the input shaft 62. The input shaft 62 is mounted to the fan pulley assembly 20, as shown in FIG. 1. In other fan cooling systems, a fan clutch may be mounted to an engine crankshaft pulley, or to a water pump pulley. The viscous fan drive 50 also includes an outer member 65 having an outer member cover 66 and body subassembly 68. The clutch plate, outer member cover 66, and body subassembly 68 have complementary, concentric lands and grooves. The clutch plate, outer member cover 66, and body subassembly 68 are assembled through a double bearing arrangement allowing for the outer member 65 to spin freely without contact about the input member 60. The resulting non-contacting mesh of lands and grooves forms a working chamber where torque is transmitted from the input member 60 to the outer member 65 in the working chamber by means of fluid shear forces through a medium of a highly viscous silicone fluid. Rotating speed of the fan 52, attached to the upper fan mounting surface 54*a* and lower fan mounting surface 54*b* and including fan blades (also 52), is varied by controlling the amount of viscous silicone fluid in the working chamber by an solenoid operated hydraulic control valve (not shown) housed within or in proximity to the electrical actuator assembly 70. The solenoid operated hydraulic control valve receives fan speed command signals via the electrical conduit 72 from fan control module 200 connected to the electrical pin connection 74 to control the amount of clutch engagement and thus the speed of the fan 52.

The input shaft 62 is then mounted to an engine coolant pump 26, both of which are driven by the fan pulley assembly 20. The fan pulley assembly 20 includes a top pulley 24*a* and bottom pulley 24*b* connected via belt 22. Engine 12 drives bottom pulley 24*b* to rotate belt 22 driving top pulley 24*a*. Top pulley 24*a* drives input shaft 62 to rotate fan 52. Speed available for bottom pulley 24*b* is limited by engine rpm. Therefore, fan 52 maximum speed depends on the engine rpm operating at full throttle. Engine 12 operating at lesser rpm, below full throttle or at idle, means the fan 52 will rotate at lesser speeds from maximum. Since a fan 52 rotating at lesser speeds from maximum may not provide for sufficient means to cool the vehicle motor due to increased temperatures or variances in loads when commanded to certain speeds by the fan control module 200, the fan control module 200 will communicate with an engine control module 120, as further described with reference to FIG. 2, so that the engine control module 120 may increase engine rpm by varying the throttle so that an effective cooling over the vehicle motor is achieved.

In other embodiments of the invention, different types of fan control configurations may be utilized in the fan cooling system 10, other than the viscous fan drive 50 described above. For example, a variable sheave fan drive may be utilized wherein the variable adjustments to fan rotation are conducted by an electronic controller by varying the diameter of pulleys connected to the fan and engine. Another fan drive that may be utilized is a hydraulic fan drive. A hydraulic fan drive includes a dedicated hydraulic engine driven by an electronically controlled variable pressure pump and fixed displacement motor driving the rotational speed of the fan. In particular, a hydraulic pump may include a dependant electro-proportional pressure control, wherein the pump pressure is controlled inversely proportional to the current through a control valve solenoid. The pump will increase displacement to satisfy system demand when the pump pressure drops below a pressure set via the solenoid current. When the pump pressure reaches the set pressure, the pump will adjust its displacement to match required system flow. Another fan drive that may be utilized is an electric fan or array of electric fans.

Figure 2:
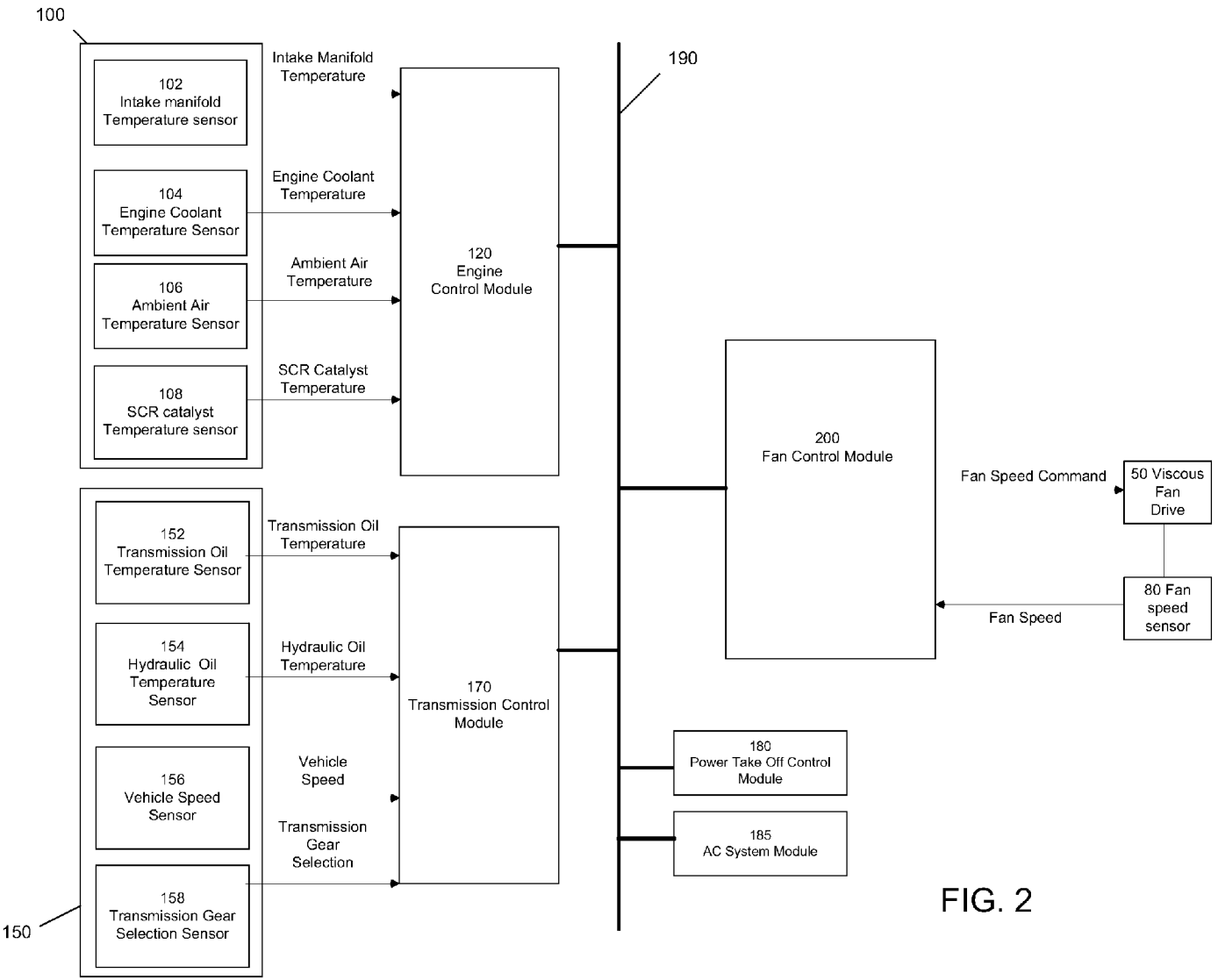
FIG. 2 shows a schematic for the interconnected control modules of the cooling system according to one embodiment of the present invention.

FIG. 2 shows a schematic for the interconnected control modules of the cooling system in at least one embodiment of the invention. The interconnected control modules include an engine control module 120, a transmission control module 170, a fan control module 200, a power take off control module 180, and an air conditioning (AC) system module 185. All five modules are connected by CAN-bus 190. In other embodiments of the invention, communication between any one or more of the five modules may be across any form of analogue or digital wired connection, across wireless connection, or within an ISOBUS integrated system.

The engine control module 120 communicates with engine 12 via an electrical connection. The engine control module 120 may command certain aspects of the engine 12 to change, as for example the engine throttle. The engine control module 120 provides the fan control module 200 with various engine information. The information may be relayed to the fan control module 200 regularly and continuously, or at various events or after certain thresholds have been surpassed. One or more of the engine information passed from the engine control module 120 to the fan control module 200 relates to sensed engine conditions, such as sensed temperatures. In one embodiment of the invention, shown in FIG. 2, four sensed temperature inputs received by the engine control module 120 from engine sensors 100 in or in proximity to the engine 12. Temperature sensed at the intake manifold of the engine 12 is provided by an intake manifold temperature sensor 102. Engine water coolant temperature is provided from an engine coolant temperature sensor 104. In some embodiments of the invention, the coolant temperature is sensed at engine output. Ambient air temperature at or around the engine 12 is provided by an ambient air temperature sensor 106. Selective catalytic reduction (SCR) catalyst temperatures are provided by a SCR catalyst temperature sensor 108. In other embodiments of the invention, additional or alternative sensor information may be provided to the engine control module 120 and then may be relayed to the fan control module 200, such as for example charge air temperature in the engine 12, engine rpm, throttle position, engine oil temperature, and/or position of the fuel injection pump rack.

As shown, the transmission control module 170 communicates with the vehicle transmission system (not shown) via an electrical connection. The transmission control module 170 provides the fan control module 200 with various transmission information. The information may be relayed to the fan control module 200 regularly and continuously, or at various events, or after certain thresholds have been surpassed. One or more of the transmission information passed from the transmission control module 170 to the fan control module 200 relates to sensed transmission conditions, including temperatures. In the illustrated embodiment, four sensed inputs received by the transmission control module 170 from transmission sensors 150 in or in proximity to the transmission system. Transmission oil is provided by a transmission oil temperature sensor 152. In some embodiments of the invention, the transmission oil temperature is sensed at an oil filter head in the transmission system. Hydraulic oil temperature is provided from a hydraulic oil temperature sensor 154. Vehicle speed is provided by a vehicle speed sensor 156. The vehicle speed sensor 156 may be located in proximity to the transmission system or wheels. The speed sensor 156 may also be incorporated into a GPS unit on the motor vehicle providing the sensed speed across a communication connection, as for example a CAN-bus. Transmission gear selection is provided by a transmission gear selection sensor 158. In other embodiments of the invention, additional or alternative sensor information may be provided to the transmission control module 170 and then may be relayed to the fan control module 200, as for example, hydrostatic oil temperature, which is sensed transmission oil temperature at a continuously variable transmission (CVT) hydrostatic inlet of the transmission system.

The power take off module 180 provides the fan control module 200 with PTO status information, in particular when the PTO is either engaged or disengaged. The information may be relayed to the fan control module 200 regularly and continuously, or at various events, or after certain thresholds have been surpassed.

The air conditioning (AC) system module 185 provides the fan control module 200 with AC status information, in particular when the AC was turned on and off, and/or the time expiration since the AC was last turned on or off. In other embodiments of the invention, the AC system 185 may alternatively or in addition provide AC set temperature, temperature sensed at or in proximity to the AC system module 185, and/or refrigerant high side and low side pressures. The information may be relayed to the fan control module 200 regularly and continuously, or at various events, or after certain thresholds have been surpassed.

FIG. 2 shows a fan control module 200 interconnected to other modules by CAN-bus 190. The fan control module 200 may receive sensed information at regular and continuous intervals, or at various events, or after certain thresholds have been surpassed. In other embodiments of the invention, the fan control module 200 receives sensed information from other modules in parallel or in series, provided from the modules at particular timed intervals and/or in particular sequence. For example, information may be relayed in order to the fan control module 200 in sequence with one message passed from the engine control module 120, then the transmission control module 170, then the power take off control module 180, then the AC system module 185, and then back to the engine control module 120 to start the sequence over again. The sequence may be different for an arrangement of modules for transmission. In other embodiments of the invention, the example sequence described above may contain transmission interrupts so as to prioritize certain messages and disrupt the normal operation transmission sequence, so that for example, if engine coolant temperature spiked or surpassed a particular threshold in a certain amount of time, then a message from the engine control module 120 would be prioritized and sent to the fan control module 200 possibly out of turn. In other embodiments of the invention, the fan control module 200 may receive an operator initiated command to, for example, stop processing when a fault has been observed by the operator or to select a particular fan speed demand, regardless of whether the fan control module 200 has generated a different speed demand than the operator.

The fan control module 200 also commands the viscous fan drive 50 to operate at a particular speed and receives sensed speed information from a fan speed sensor 80. The fan control module 200 may compare received sense speed with fan speed command sent to the fan drive 50. In some embodiments of the invention, the fan control module 200 may constantly, or at predetermined intervals, calculate differences between sensed speed and commanded speed. The fan control module 200 may also continuously try and reduce those differences. In other embodiments of the invention, the fan control module 200 may only process input information to derive a speed command in the instance that at least one of the inputs has changed. In other embodiments of the invention, the fan control module 200 may continuously process input information, whether any input signal has changed or not, to continuously derive a speed command and/or confirm that previously processed and transmitted speed commands were correct. By continuously processing input signals, regardless of change, the fan control module 200 can compare the speed command to fluctuations in fan speed provided by the fan speed sensor 80 and reduce differences if needed.

The fan control module 200 may monitor for any errors or faults when comparing the fan speed command with the received sense speed. For example, fan control module 200 may flag a failure and generate a failure message to the other control modules within the vehicle across the CAN-bus 190 or alert the operator of the vehicle. In some embodiments of the invention, a failure may set, as determined by the fan control module 200, when the speed sensed by the fan speed sensor 80 fails to achieve the desired fan speed as commanded to the viscous fan drive 50 after a predetermined amount of time. In other embodiments of the invention, a failure may set, as determined by the fan control module 200, when the speed sensed by the fan speed sensor 80 fails to climb or drop at a preferred rate after the desired fan speed is commanded to the viscous fan drive 50. In other embodiments of the invention, the operator may set the speed command to the viscous fan drive 50.

Figure 3:
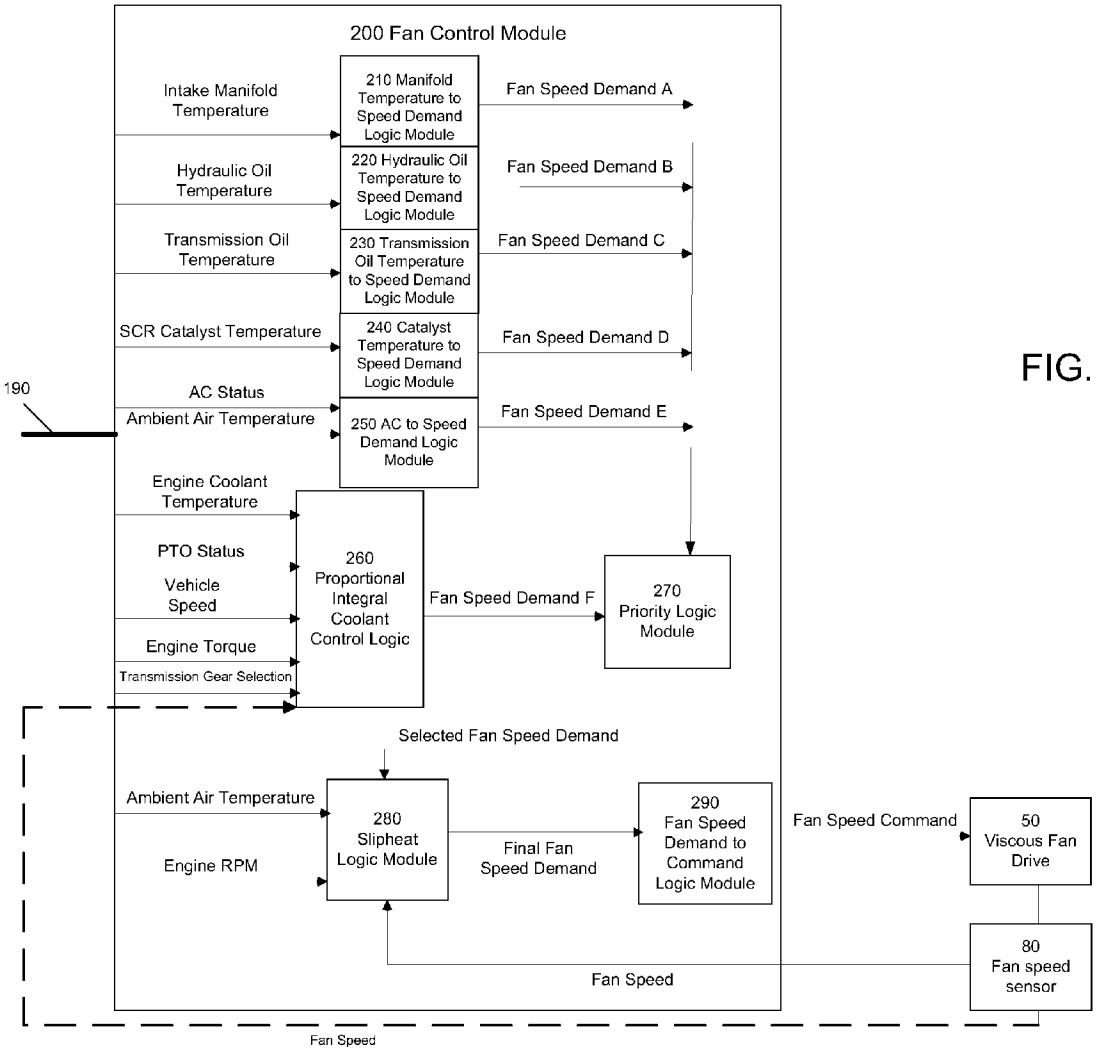
FIG. 3 shows a detailed schematic of the fan control module from FIG. 2 according to one embodiment of the present invention.

FIG. 3 shows a detailed schematic of the fan control module from FIG. 2 in at least one embodiment of the present invention. FIG. 3 shows the interconnected logic and control modules, various inputs to the fan control module 200 arriving via the CAN-bus 190, and the fan speed command output passed to the viscous fan drive 50.

The fan control module 200 can be one or more microcomputers, microcontrollers, or processors including appropriate peripherals such as memory, power source, data buses, and other circuitry appropriate for carrying out its functionality. The fan control module 200 can use memory to store data (e.g. saved settings, recorded status information, configuration files, user profiles, etc) or instructions (e.g. applications, algorithms, or programs used in the operation of the present invention) for use during operation of the cooling system 10. Memory (not shown) is accessible to fan control module 200 and can be a local RAM, ROM, flash memory, hard drive, solid state storage, removable memory, or any combination or subset thereof.

The fan control module 200 can be a single unit located near or in proximity to the viscous fan drive 50 or anywhere else in the vehicle. The fan control module 200 may be part of a larger electronic control circuit interconnected and located within the engine control module 120, transmission control module 170, packaged together with either or both modules, or stand alone.

The fan control module 200 processes the various inputs transmitted from the CAN-bus 190. Input information provided by the CAN-bus is forwarded to one or more logic modules, in the fan control module 200, containing either software or hardware logic algorithms such as comparators, logic gates, table look-up arrays, mathematical implements, and any other logic types for processing the related inputs. The logic modules may contain their own microcomputers, microcontrollers, processors, memory, or any other computing component to perform functions further described below. These logic modules, each described more fully below, generate fan speed demand as a function of processing inputs entering the particular logic module. The logic modules are capable of determining demands from one or more of these inputs. The fan speed demand generated at every logic module equates to the minimum fan speed required based on the inputs into the module.

A priority logic module 270, housed within the fan control module, selects the highest fan speed demands outputted from the logic modules supplying fan speed demands. As shown in FIG. 3, the priority logic module 270 selects a single fan speed demand from six fan speed demands supplied from the various logic modules. In one embodiment of the invention, the six fan speed demands inputted into the priority logic module 270 are labeled fan speed demand A, fan speed demand B, fan speed demand C, fan speed demand D, fan speed demand E, and fan speed demand F. Input fan speed demands may be transmitted to the priority logic module 270 in parallel and synchronously, linear and ordered, or sporadically. The priority logic module 270 may compare the inputs anytime one or more input speed demands are supplied or at certain time intervals, by storing previously received input speed demands in memory until it is time to compare all input speed demands. The priority logic module 270 may select a fan speed demand from the input fan speed demands when only at lease one value from the one or more input fan speed demands has changed.

Each fan speed demand input to the priority logic module 270 is a functional outcome of the one or more control demand logic modules integrated into the fan control module 200. Each control demand logic module determines a fan speed demand based on one or more input signals transmitted to the fan control module 200.

As shown in FIG. 3, a manifold temperature to speed demand logic module 210 generates an output fan speed demand A signal. The intake manifold temperature to speed demand logic module 210 receives intake manifold temperature, as relayed from the engine control module 120 across the CAN-bus 190 to the fan control module 200. Fan speed demand A is generated as a function of the intake manifold temperature by a determination of fan speed from a table of intake manifold temperatures versus target fan speeds. The fan speed demand A is selected from the target fan speed in relation to the intake manifold temperature in the table approximating the input intake manifold temperature. In other embodiments of the invention, the manifold temperature to speed demand logic module 210 may also generate a fan speed demand based on the difference between input intake manifold temperature and an input of the ambient air temperatures also provided by the engine control module 120. In other embodiments of the invention, the manifold temperature to speed demand logic module 210 may generate a fan speed demand based one or more alternative or additional inputs.

As shown in FIG. 3, a hydraulic oil temperature to speed demand logic module 220 generates an output fan speed demand B signal. The hydraulic oil temperature to speed demand logic module 220 receives hydraulic oil temperature, as relayed from the transmission control module 170 across the CAN-bus 190 to the fan control module 200. Fan speed demand B is generated as a function of the hydraulic oil temperature by a determination of fan speed from a table of the hydraulic oil temperatures versus target fan speeds. The fan speed demand B is selected from the target fan speed in relation to the hydraulic oil temperature in the table approximating the input hydraulic oil temperature. In other embodiments of the invention, the hydraulic oil temperature to speed demand logic module 220 may generate a fan speed demand based one or more alternative or additional inputs.

As shown in FIG. 3, a transmission oil temperature to speed demand logic module 230 generates an output fan speed demand C signal. Transmission oil temperature may likely incur greater demand for fan speed, when the transmission gears are turning at high speeds thus increasing the oil temperature due to increased friction across the rotating gears. The transmission oil temperature to speed demand logic module 230 receives transmission oil temperature, as relayed from the transmission control module 170 across the CAN-bus 190 to the fan control module 200. Fan speed demand C is generated as a function of the transmission oil temperature by a determination of fan speed from a table of the transmission oil temperatures versus target fan speeds. The fan speed demand C is selected from the target fan speed in relation to the transmission oil temperature in the table approximating the input transmission oil temperature. In other embodiments of the invention, the transmission oil temperature to speed demand logic module 230 may generate a fan speed demand based one or more alternative or additional inputs.

As shown in FIG. 3, a catalyst temperature to speed demand logic module 240 generates an output fan speed demand D signal. The catalyst temperature to speed demand logic module 240 receives SCR catalyst temperature, as relayed from the engine control module 120 across the CAN-bus 190 to the fan control module 200. Fan speed demand D is generated as a function of the SCR catalyst temperature by a determination of fan speed from a table of the SCR catalyst temperatures versus target fan speeds. The fan speed demand D is selected from the target fan speed in relation to the SCR catalyst temperature in the table approximating the input SCR catalyst temperature. In other embodiments of the invention, the catalyst temperature to speed demand logic module 240 may generate a fan speed demand based one or more alternative or additional inputs.

As shown in FIG. 3, an air conditioning (AC) to speed demand logic module 250 generates an output fan speed demand E signal. The AC to speed demand logic module 250 receives ambient air temperature, as relayed from the engine control module 120 across the CAN-bus 190 to the fan control module 200. The AC to speed demand logic module 250 also receives AC status information from the AC system module 180, and in particular the time since the AC system was last turned on. In other embodiments of the invention, the AC system module 180 may transmit when the AC was turned on or off, and the AC to speed demand logic module 250 will compute the time passed since the AC was turned on or off. AC to speed demand logic module 250 generates two fan speed demands internally and selects the higher of the two to be fan speed demand D. One of the two fan speed demands is a function of the time since the AC turned on by a determination of fan speed from a table of the time since AC turn on versus fan speed demand. The other fan speed demand is a function of ambient air temperature based on the fan speed demand. In other embodiments of the invention, the AC to speed demand logic module 250 may generate a fan speed demand based one or more alternative or additional inputs, as for example engine torque. In other embodiments of the invention, the AC to speed demand logic module 250 may transmit both fan speed demands, one based on time since AC turn on and the other based on ambient air temperature, to the priority logic module 270 for the priority logic module 270 to select.

As shown in FIG. 3, a proportional integral coolant control logic module 260 generates an output fan speed demand F signal. In both normal operation and operation with significant loading, the greatest of fan speed demands is most likely due to engine coolant temperature. The proportional integral coolant control logic module 260 receives engine coolant temperature, as relayed from the engine control module 120 across the CAN-bus 190 to the fan control module 200. The proportional integral coolant control logic module 260 also receives PTO status information from the power take off control module 180, and in particular whether the PTO is engaged or disengaged. The proportional integral coolant control logic module 260 also receives vehicle speed, as relayed from the transmission control module 170 across the CAN-bus 190 to the fan control module 200. The proportional integral coolant control logic module 260 may also receive transmission gear selection, as relayed from the transmission control module 170 across the CAN-bus 190 to the fan control module 200. The proportional integral coolant control logic module 260 also receives engine torque, provided by the engine control module 120 across the CAN-bus 190 to the fan control module 200.

Figure 4:
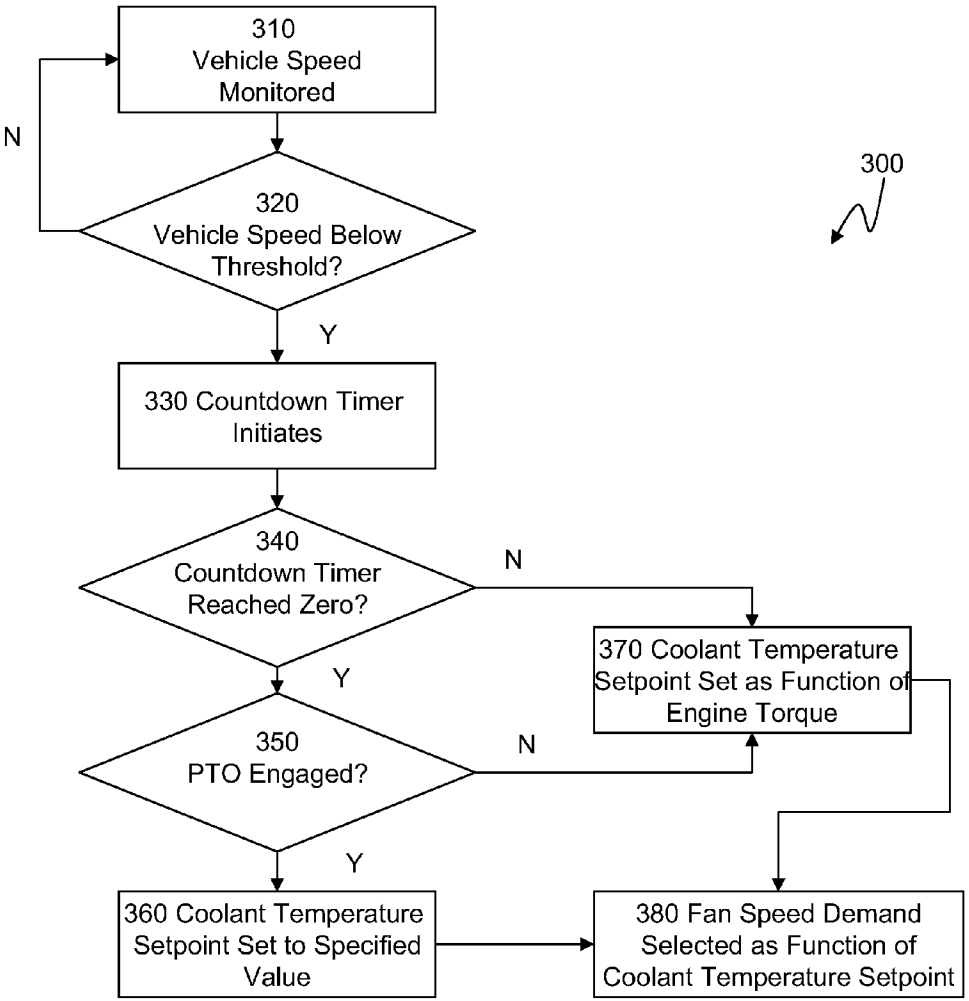
FIG. 4 shows a process for generating a coolant temperature set point to determine a fan speed in at least one embodiment of the present invention.

The proportional integral coolant control logic module 260 incorporates a proportional and integral control loop with a feed forward term, wherein the coolant temperature set point is selected based on the operation state of the tractor. FIG. 4 shows a coolant temperature generating process 300 for generating a coolant temperature set point to determine a fan speed demand in the proportional integral coolant control logic module 260. In step 310, vehicle speed is monitored by the proportional integral coolant control logic module 260. The proportional integral coolant control logic module 260 determines if the vehicle speed is below a threshold value in step 320. If the vehicle speed is not below a threshold value then the proportional integral coolant control logic module 260 continues to monitor vehicle speed in step 310. When the vehicle speed falls below a particular speed threshold, a countdown timer is initiated by the proportional integral coolant control logic module 260 in step 330. In some embodiments of the invention, the speed threshold may be 5 kph or any other value below 5 kph and greater than 0 kph, as for example 1 kph. The proportional integral coolant control logic module 260 determines whether the countdown time reached zero in step 340 and whether the PTO is engaged in step 350. If the PTO is engaged and the timer reaches zero, the coolant temperature set point is set to a specified temperature in step 360. In this one embodiment of the invention, the specified temperature is set to 103 degrees Celsius. In other embodiments of the invention, the specified temperature may be set to a value equal to or below 105 degrees Celsius. In other embodiments of the invention, the specified temperature may be set to a value equal or approximate to the temperature at which degradation of engine performance exists or to the derate of an engine when the engine begins cutting back on fueling. In other embodiments of the invention, the specified temperature may be set to a value equal or approximate to the temperature at which engine redline is defined on an instrument cluster (not shown) as viewed by an operator. In some embodiments of the invention, the specified temperature is at least 2 degrees Celsius below the engine derate temperature and/or engine redline. So for example if the temperature limit at engine redline is 110 degrees Celsius, then the specified temperature is less than or equal to 108 degrees Celsius. If the PTO is not engaged nor the timer has not run out, the coolant temperature set point is selected as a function of the engine torque via a table lookup of engine torque versus coolant temperatures in step 370. Fan speed demand F is then selected via table lookup of fan speeds versus coolant temperature set points in step 380.

In other embodiments of the invention, the proportional integral coolant control logic module 260 utilizes transmission gear selection in addition to or in alternative to vehicle speed. In other embodiments of the invention, the proportional integral coolant control logic module 260 may also receive fan speed, provided by the fan speed sensor 80. The proportional integral coolant control logic module 260 may then monitor the fan speed directly so as to immediately adjust the fan speed demand F if engine coolant temperature is varying or surpassing specified temperatures significantly impacting the performance of the engine 12.

In other embodiments of the invention, a more accurate sensed reading of coolant temperature provided to the proportional integral coolant control logic module 260 allows for the module 260 to ascertain needed adjustments to the coolant temperature set point so that the fan control module 200 can react faster to set the fan speed command and improve the efficiency of the fan cooling system. For example, if the coolant temperature was sensed with improved resolution such as reading 102.6 degrees Celsius rather than 102 degrees Celsius, then the proportional integral coolant control logic module 260 could react faster as fluctuations of the temperature at a tenths or hundredths degree occurred.

By implementing the functionality described above for operating the coolant temperature at the higher set point, with the PTO engaged and tractor still in motion, thus in a stable low speed condition, a more efficient cooling operation is conducted in the fan cooling system 10. In other embodiments of the invention, a higher coolant temperature set point is selected when the PTO is engaged and the vehicle speed is 0 kph.

Referring back to FIG. 3, a selected fan speed demand is determined from the maximum of the fan speed demand inputs transmitted to the priority logic module 270. In this embodiment of the invention the selected fan speed demand is transmitted to a slip heat logic module 280 after selection by the priority logic module 270. Prior to a final fan speed demand being determined in the fan control module 200 for conversion to a fan speed command in the fan speed demand to command logic module 290, the slip heat logic module 280 provides protection to the fan drive as a function of several inputs.

As shown in FIG. 3, the slip heat logic module 280 generates an output final fan speed demand signal for transmission to the fan speed demand to command logic module 290. In this embodiment of the invention, the slip heat logic module 280 receives selected fan speed demand from the priority logic module 270. The slip heat logic module 280 also receives ambient air temperature, as relayed from the engine control module 120 across the CAN-bus 190 to the fan control module 200. The slip heat logic module 280 also receives fan speed from the fan speed sensor 80. The slip heat logic module 280 also receives engine rpm provided from the engine control module 120. In other embodiments of the invention, the slip heat logic module 280 may receive in alternative or addition to the above stated inputs, engine coolant temperature, as relayed from the engine control module 120 across the CAN-bus 190 to the fan control module 200, or other various sensed information.

The viscous fan drive 50 also requires cooling. When air temperature flowing over the viscous fan drive 50 restricts cooling to the fan drive 50 a reduction in the amount of heat dissipating from the fan drive 50 is needed. The slip heat protection module 280 prevents the fan drive clutch from trying to maintain a fan speed wherein the clutch dissipates more heat than the design limits of the clutch. The final fan speed demand transmitted from the slip heat protection module 280 is a function of the received fan speed, received engine rpm, received ambient air temperature, and calibration limits preprogrammed and stored into the slip heat protection module 280.

Figure 5:
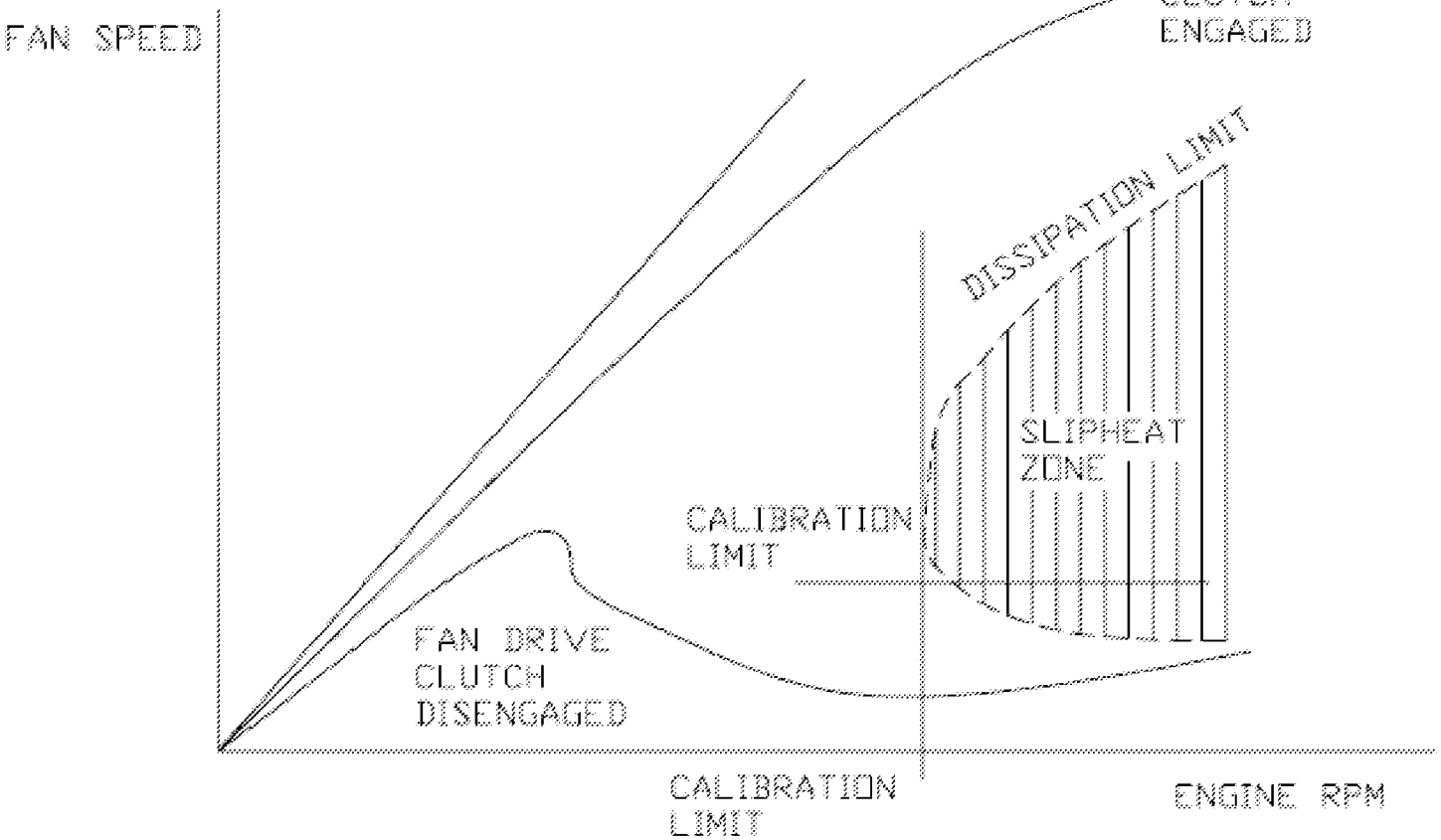
FIG. 5 shows a graphical representation for slip heat protection according to one embodiment of the present invention.

FIG. 5 shows a graphical representation for slip heat protection according to one embodiment of the present invention. The graph represents fan drive dissipation limits as calculated by the slip heat logic module 280 to change the fan speed set point requested by the temperature demand so the fan drive is no longer operating in the slip heat region, identified in FIG. 5 as the 'slip heat zone', for the viscous fan drive 50 in the event that the viscous fan drive 50 begins operating beyond recommended clutch heat dissipation limits. The x-axis of the graph represents engine rpm and the y-axis represents fan speed. Calibration limits are imposed by the slip heat protection module 280 between the curved lines representing when the fan drive clutch is engaged and when the fan drive clutch is disengaged. The curve dotted line represents a constant heat dissipation limit of the clutch, wherein operation of the viscous fan drive 50 in the zone to the right of this curve will exceed the recommended clutch heat dissipation limit. The zone is labeled 'slip heat zone' and is identified by the hash marks shown in FIG. 5. The viscous fan drive 50 is commanded to a fan speed that is above the slip heat limit curve, or commanded below the slip heat limit curve, thus commanding the fan speed to a higher or lower speed as a result, depending on the required amount of cooling requested. The slip heat logic module 280 may use various temperature calibration limits to maintain the fan cooling system 10 within temperature requirements for a give motor vehicle. The slip heat logic module 280 may also provide for hysteresis to limit cycling through the slip heat zone.

In other embodiments of the invention, a hydraulic fan drive, variable sheave fan drive, or electric fans may be incorporated into fan cooling system 10, in alternative to the viscous fan drive 50 represented in the this embodiment of the invention. As shown in FIG. 3, a selected fan speed demand is transmitted to the slip heat logic module 280 and an output final fan speed demand is transmitted from the slip heat logic module 280 to the fan speed demand to command logic module 290. If a hydraulic fan drive is incorporated, then a slip heat logic module 280 may not need to exist within the fan control module 200 such that selected fan speed demand from the priority logic module 270 is the final fan speed demand transmitted to the fan speed demand to command logic module 290. If a variable sheave fan drive is incorporated, then the slip heat logic module 280 may again exist within the fan control module 200, however the inputs to the slip heat logic module 280 for the variable sheave fan drive may or may not replicate the same inputs transmitted to the slip heat logic module 280 when the viscous fan drive is incorporated. In other embodiments of the invention, when a viscous fan drive is incorporated, the fan control module 200 may not incorporate a slip heat logic module 280 into the fan speed demand processing so that the priority logic module 270 instead transmits a final fan speed demand directly to the fan speed demand to command logic module 290. In other embodiments of the invention, the slip heat logic module 280, for a viscous fan drive, derives the final fan speed demand as a function of alternative or additional inputs than those described in reference to inputs shown in FIG. 3.

As shown in FIG. 3, a fan speed demand to command logic module 290 generates a fan speed command to the viscous fan drive 50 to adjust or maintain the rotational speed of fan 52. In other embodiments of the invention, the final fan speed demand is simply passed from the slip heat logic module 280 to the fan drive 50 to vary the speed of the fan 52. In other embodiments of the invention, the priority logic module 270 transmits a final fan speed demand and/or fan speed command to the viscous fan drive 50, as selected from the fan speed demand inputs to the priority logic module 270.

As shown in FIG. 3, fan speed is fed back from the fan speed sensor 80 to various modules in the fan control module 200. In the present embodiment of the invention, the fan speed is transmitted to the slip heat logic module 280 and utilized to generate the final fan speed demand. In other embodiments of the invention, fan speed may be transmitted to the fan speed demand to command logic module 290 in alternative or addition to transmission to the slip heat logic module 280. In addition or alternative, the fan speed may be transmitted to the priority logic module 270. In other embodiments, as described above, the fan speed may be transmitted to the proportional integral coolant control logic module 260.

Although the invention has been described with reference to exemplary embodiments, it is not limited thereto. Those skilled in the art will appreciate that numerous changes and modifications may be made to the preferred embodiments of the invention and that such changes and modifications may be made without departing from the true spirit of the invention. It is therefore intended that the appended claims be construed to cover all such equivalent variations as fall within the true spirit and scope of the invention.

What is claimed:

1. A fan control system for use with a fan cooling system in a vehicle comprising:

a fan drive for driving a fan blade to rotate at a particular speed;

one or more sensors for sensing engine conditions and transmission conditions;

an engine control module coupled to the one or more sensors for receiving engine conditions comprising at least an engine coolant temperature, the engine control module coupled to a communication link for transmitting engine information comprising engine conditions;

a transmission control module coupled to the one or more sensors for receiving transmission conditions comprising at least a vehicle speed, the transmission control module coupled to the communication link for transmitting transmission information comprising transmission conditions;

a power take off control module coupled to the communication link for transmitting power take off status information, wherein the power take off status information comprises whether a power take off unit on the vehicle is engaged or disengaged;

a fan control module coupled to the communication link for receiving engine information, transmission information, and power take off status information to process the engine information, the transmission information, and the power take off status information and to generate one or more fan speed demands from the processed information; wherein the fan control module selects from the one or more fan speed demands a maximum fan speed demand to command the fan drive to rotate the fan blade at a commanded rotational fan speed based on the maximum fan speed demand;

wherein the fan control module generates at least one of the fan speed demands by processing the engine coolant temperature, the power take off status information, and the vehicle speed;

wherein when the vehicle speed of the vehicle is greater than 0 KPH and the power take off unit is engaged, the fan control module raises a set point of the engine coolant temperature to reduce the fan speed demand processed from the engine coolant temperature, the power take off status information, and the vehicle speed; and wherein the communication link connects the engine control module, transmission control module, and power take off control module to the fan control module.

2. The fan control system of claim 1, further comprising a fan speed sensor connected to the fan drive to measure the rotational speed of the fan blade and to communicate the sensed rotational speed of the fan blade to the fan control module.

3. The fan control system of claim 2, wherein the fan control module processes the sensed rotational speed of the fan blade with the engine information, transmission information, and power take off status information to generate the one or more fan speed demands.

4. The fan control system of claim 3, wherein the engine information received by the fan control module comprises ambient air temperature and engine rpm and wherein the fan control module processes a slip heat protection based on the ambient air temperature, the engine rpm, the sensed rotational speed of the fan blade, and the selected fan speed demand.

5. The fan control system of claim 4, wherein the fan control module commands the fan drive to change rotation of the fan blade based on the processed slip heat protection so that the fan drive will not maintain a rotational fan speed of the fan blade so as to overheat beyond design limits of the fan drive.

6. The fan control system of claim 3, wherein the fan control module calculates differences between commanded rotational fan speed and sensed rotational fan speed and modulates the commanded rotational fan speed to reduce the differences.

7. The fan control system of claim 1, wherein the engine information received by the fan control module includes an intake manifold temperature and wherein the fan control module processes the intake manifold temperature to generate the one or more fan speed demands.

8. The fan control system of claim 1, wherein the engine information received by the fan control module includes a catalyst temperature and wherein the fan control module processes the catalyst temperature to generate the one or more fan speed demands.

9. The fan control system of claim 1, wherein the fan control module further comprises a timer that counts to a specified time after the vehicle speed drops below a vehicle speed threshold value.

10. The fan control system of claim 9, wherein the fan control module raises the set point of the engine coolant temperature when the specified time is reached if the power take off unit is engaged.

11. The fan control system of claim 10, wherein the vehicle speed threshold value comprises any speed value less than or equal to 5 KPH and greater than 0 KPH.

12. The fan control system of claim 1, wherein the set point of the engine coolant temperature comprises a temperature value less than or equal to engine derate temperature.

13. The fan control system of claim 12, wherein the set point of the engine coolant temperature comprises a temperature value approximately 2 degrees Celsius below the engine derate temperature.

14. The fan control system of claim 12, wherein the set point of the engine coolant temperature comprises a temperature value approximately 2 degrees Celsius below engine redline as defined on an instrument cluster.

15. The fan control system of claim 1, further comprising an air conditioning system module for transmitting air conditioning system status information, wherein the air conditioning system status information comprises whether an air conditioning system in the vehicle is turned on or off.

16. The fan control system of claim 15, wherein the fan control module further includes receiving air conditioning status information and an ambient air temperature from the engine information to generate two fan speed demands, wherein the fan control module calculates a first fan speed demand based on a time since the air conditioning system last turned on and generates a second fan speed demand based on the ambient air temperature.

17. The fan control system of claim 1, wherein the communication link is a CAN-bus.

18. The fan control system of claim 1, wherein the fan drive is a viscous fan drive.

19. A method for controlling a speed of a fan blade in a fan cooling system of a vehicle comprising:

sensing vehicle motor conditions including engine conditions and transmission conditions at one or more sensors;

receiving at an engine control module one or more engine conditions, including at least an engine coolant temperature, from the one or more sensors;

transmitting engine information including engine conditions on a communication link from the engine control module to a fan control module;

receiving at a transmission control module one or more transmission conditions, including at least a vehicle speed, from the one or more sensors;

transmitting transmission information including transmission conditions on the communication link from the transmission control module to the fan control module;

transmitting power take off status information from a power take off control module on the communication link from the power take off control module to the fan control module, wherein the power take off status information is whether a power take off unit on the vehicle is engaged or disengaged;

receiving engine information, transmission information, and power take off status information at the fan control module;

processing the engine information, transmission information, and power take off status information at the fan control module;

generating one or more fan speed demands at the fan control module based on the processed engine information, transmission information, and power take off status information, and wherein at least one of the fan speed demands is generated by processing the engine coolant temperature, power take off status information, and vehicle speed;

raising a set point of the engine coolant temperature by the fan control module to reduce the fan speed demand processed from the engine coolant temperature, the power take off status information, and the vehicle speed when the vehicle speed of the vehicle is greater than 0 KPH and the power take off unit is engaged;

selecting at the fan control module a maximum fan speed demand from the one or more fan speed demands; and commanding from the fan control module a fan drive to rotate a fan blade connected with the fan drive at a commanded fan speed based on the maximum fan speed demand selected by the fan control module.

20. The method of claim 19, further comprising sensing a rotational fan speed by a fan speed sensor connected with the fan blade and transmitting the sensed speed of the fan to the fan control module from the fan speed sensor.

21. The fan control system of claim 20, wherein the fan control module modifies commanded fan speed based on received sensed fan speed from the fan speed sensor.

22. The method of claim 19, further comprising: sensing a gear selected in the transmission system at the one or more sensors, receiving the gear selected in the transmission system at the transmission control module from the one or more sensors, and transmitting the gear selected in the transmission system on the communication link from the transmission control module to the fan control module.

23. The method of claim 22, wherein generating one or more fan speed demands comprises processing the engine coolant temperature, power take off status information, and the selected gear from the transmission information.

24. The method of claim 19, further comprising reducing heat dissipating from the fan drive beyond fan drive design limits by replacing the fan speed command with a lower or higher speed command to the fan drive from the fan control module.

25. The method of claim 19, wherein the raising a set point of the engine coolant temperature step further comprises counting a time down to zero after the vehicle speed drops below a vehicle speed threshold and raising the set point when the time reaches zero.

26. The method of claim 25, wherein the vehicle speed threshold value may be any speed value greater than 0 KPH and less than or equal to 5 KPH.

27. The method of claim 25, further comprising basing the set point of the engine coolant temperature off an engine torque in the engine information when the time has not reached zero or the power take off unit is disengaged.

* * * * *